US008581135B2

(12) United States Patent
Piccoz et al.

(10) Patent No.: US 8,581,135 B2
(45) Date of Patent: Nov. 12, 2013

(54) LATCHING AND LOCKING DEVICE INSIDE A SWITCH OR A CIRCUIT BREAKER

(75) Inventors: Daniel Piccoz, Lucenay (FR); Floriane Decq, Saint Etienne sur Reyssouze (FR); Patrice Grosjean, Varennes St Sauveur (FR)

(73) Assignee: Schneider Electric Energy France, Rueil Malmaison (FR)

( * ) Notice: Subject to any disclaimer, the term of this patent is extended or adjusted under 35 U.S.C. 154(b) by 202 days.

(21) Appl. No.: 13/266,806

(22) PCT Filed: May 25, 2010

(86) PCT No.: PCT/EP2010/057106

§ 371 (c)(1),
(2), (4) Date: Oct. 28, 2011

(87) PCT Pub. No.: WO2010/136424

PCT Pub. Date: Dec. 2, 2010

(65) Prior Publication Data

US 2012/0048692 A1 Mar. 1, 2012

(30) Foreign Application Priority Data

May 26, 2009 (FR) ..... 09 53461

(51) Int. Cl.
*H01H 33/66* (2006.01)

(52) U.S. Cl.
USPC ..... 218/140; 218/14; 218/120

(58) Field of Classification Search
USPC ..... 218/14, 120, 140
See application file for complete search history.

(56) References Cited

U.S. PATENT DOCUMENTS

| | | | | |
|---|---|---|---|---|
| 2,773,154 A | | 12/1956 | Williams | |
| 3,778,568 A | * | 12/1973 | Wilson | 200/50.22 |
| 3,787,649 A | * | 1/1974 | Goodwin et al. | 200/400 |
| 3,823,281 A | * | 7/1974 | Wilson | 200/50.24 |
| 4,591,678 A | | 5/1986 | Yin | |

FOREIGN PATENT DOCUMENTS

DE 10 2005 002 139 7/2006

OTHER PUBLICATIONS

International Search Report Issued Aug. 25, 2010 in PCT/EP10/057106 Filed May 25, 2010.

* cited by examiner

*Primary Examiner* — Truc Nguyen
(74) *Attorney, Agent, or Firm* — Oblon, Spivak, McClelland, Maier & Neustadt, L.L.P.

(57) ABSTRACT

The embodiments of the switch described herein include latching and locking systems so as to retain the rod of a vacuum bottle in a determined, open or closed, position, the systems being driven and controlled by the same means that cause the movable portion of the vacuum bottle to move, or by the disconnector itself.

2 Claims, 6 Drawing Sheets

LATCHING AND LOCKING DEVICE INSIDE A SWITCH OR A CIRCUIT BREAKER

Figure 1:
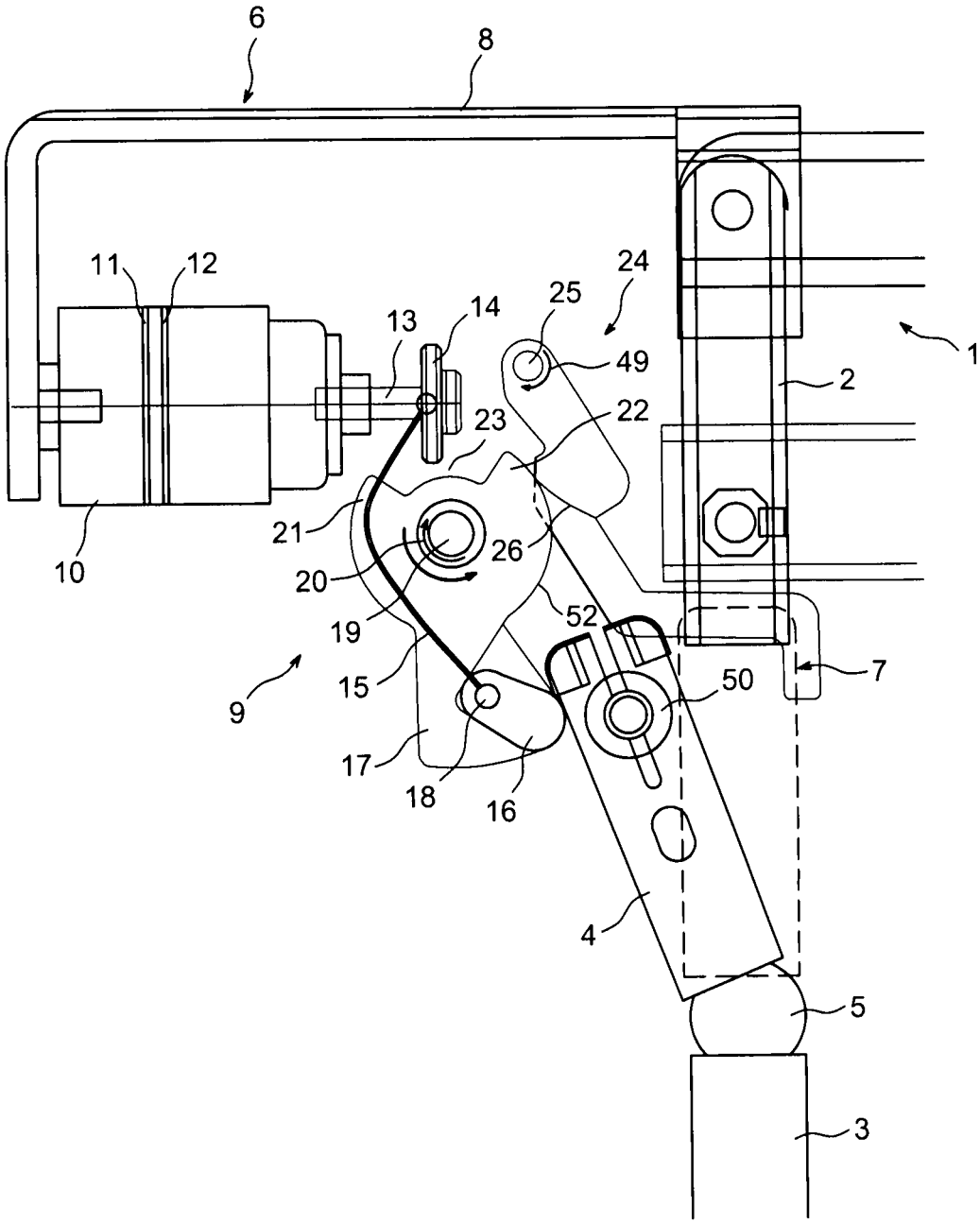

The invention relates to a latching or locking device inside a switch or circuit breaker and not part of the separate control mechanism.

By way of example, such latching and locking may be implemented in the switch described in the French patent application No. 08/57373. The device includes a main branch for passing electric current, equipped with a disconnector element having three functions (electric current switch, actuator, disconnector), driven at will under the effect of a control mechanism. A secondary branch including a vacuum bottle is installed in parallel with the main branch downstream from the disconnector (a stationary end connected to the main branch, and a movable end that is free while the switch/circuit-breaker is in the closed position), so that current is able to flow when the disconnector is put into contact with the movable end. The electric current is broken by opening the vacuum bottle immediately after opening the main branch. Advantageously, by initially transferring the electric current to the parallel branch, that layout prevents an electric arc from forming when the disconnector in the main branch is opened; the vacuum bottle then effectively prevents an electric arc from forming when the parallel branch is opened. Placing the vacuum bottle in a parallel branch serves to avoid overloading the vacuum bottle, since, in normal operation, the current flows through the main branch, and thus makes it possible to select a vacuum bottle of lower performance.

The above-mentioned document provides for the vacuum bottle to close immediately after the circuit has been opened, in such a manner that the entire parallel branch has the same electrical potential so long as the switch remains open. An opposite state may be preferred, in which the vacuum bottle remains in the open state with the switch, for example in order to protect against the parallel branch re-closing too quickly, without guaranteeing the circuit is broken. Conversely, for reasons of safety it may be desirable to impose a closed state on the vacuum bottle so long as the main branch remains closed, in order to guarantee the transfer of current from the main branch to the parallel branch when the disconnector starts to open.

A document representing a neighbouring prior art is U.S. Pat. No. 2,773,154.

In a general aspect, the invention relates to a device associated with a switch or a circuit breaker, comprising a main branch for the flow of electric current and including a disconnector, and a secondary branch for the flow of electric current in parallel with the main branch and including a stationary portion, a movable portion, and a vacuum bottle at the junction between the stationary portion and the movable portion, the device being arranged in such a manner that the disconnector drives the movable portion during a fraction of a stroke between an open state and a closed state of the device, including a movable mechanism that is movable with the disconnector, and that is arranged in such a manner as to engage with the movable portion of the secondary branch and prevent it from moving after said fraction of a stroke, characterized in that the mechanism comprises a latch finger urged by a spring towards the movable portion and that can be displaced against the spring during a first fraction of a stroke towards a close of the disconnector, and in that the movable part of the secondary branch includes a latch cam that co-operates with the latch finger, during a second fraction of the stroke and towards the close, and the latch cam and the latch finger presenting mutual slip portions and mutual blocking portions.

By comparison to U.S. Pat. No. 2,773,154, the invention concerns a circuit breaker in which the cam is blocked by an autonomous latch finger instead of a cam follower belonging to the movable part of the secondary branch. The inventive layout is better as to kinematics because switchings are easier, the cam follower in U.S. Pat. No. 2,773,154 must pass through an uprising surge in the way from one recess to another during the displacement of the movable part of the secondary branch.

Figure 2:
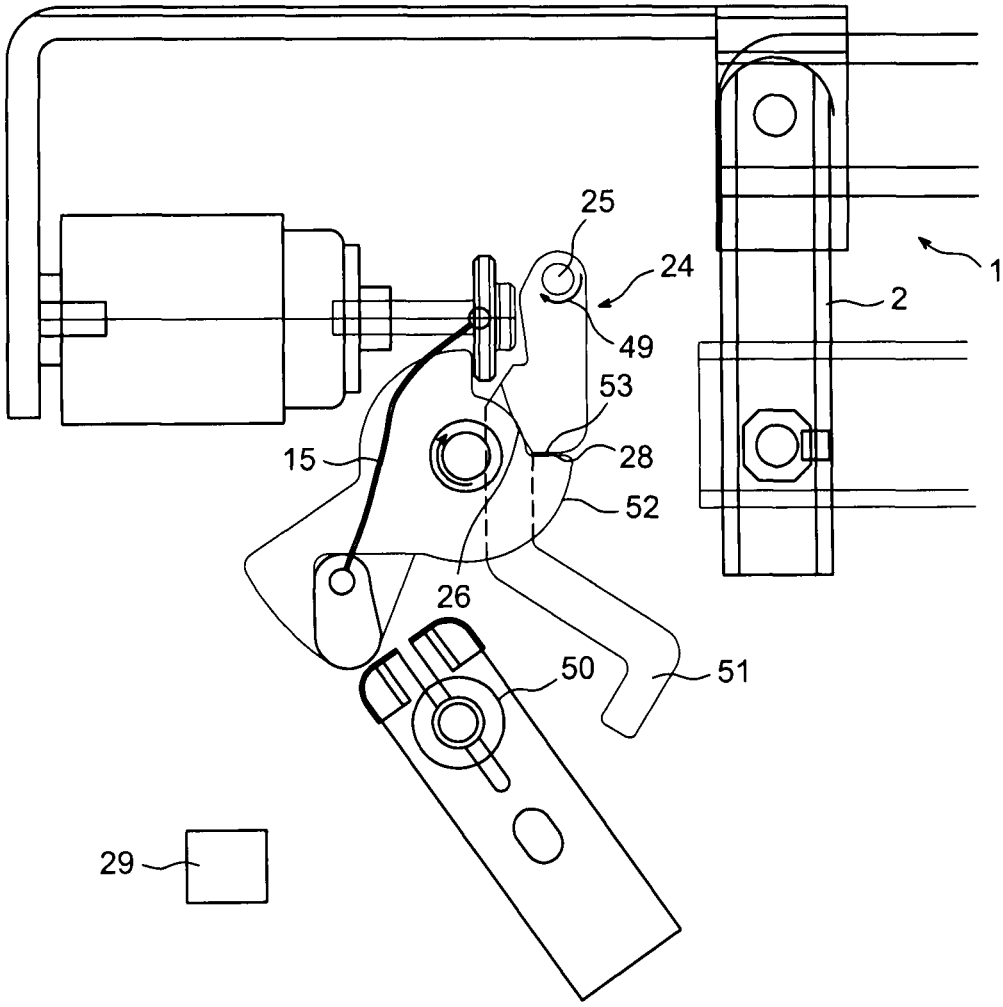
Figure 3:
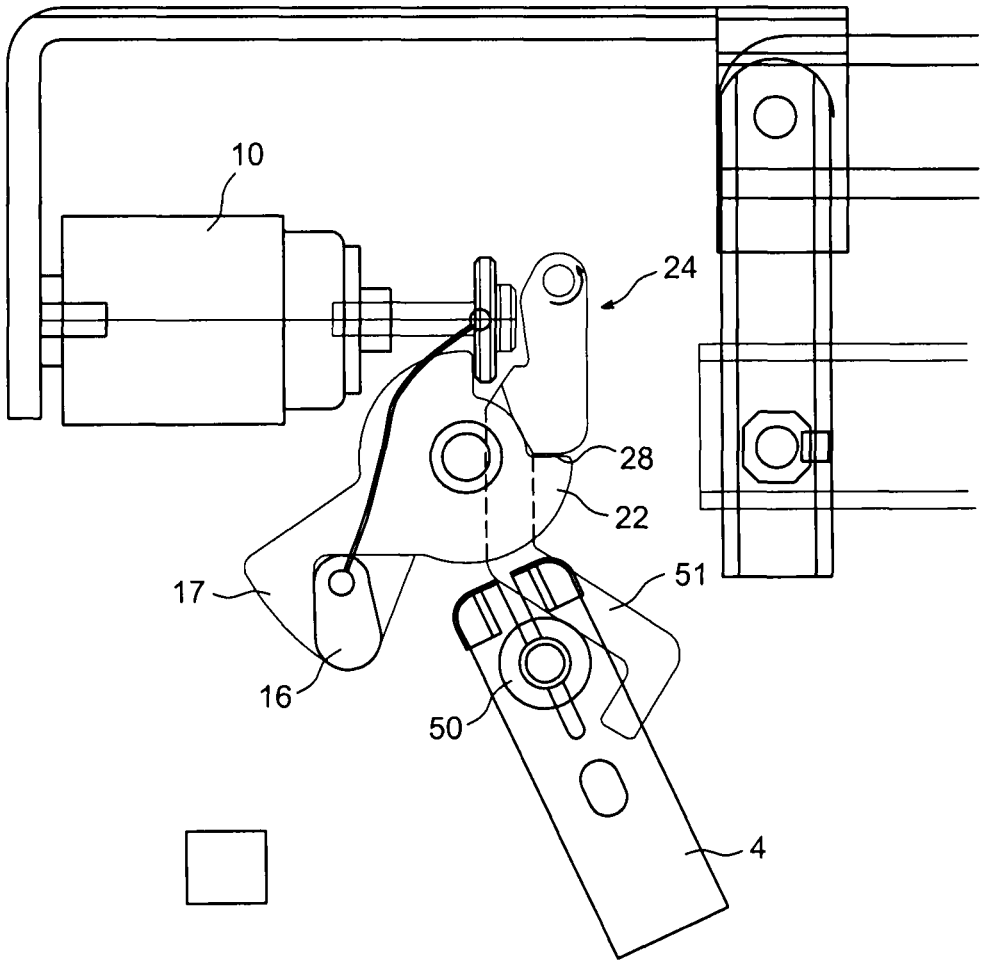
Figure 4:
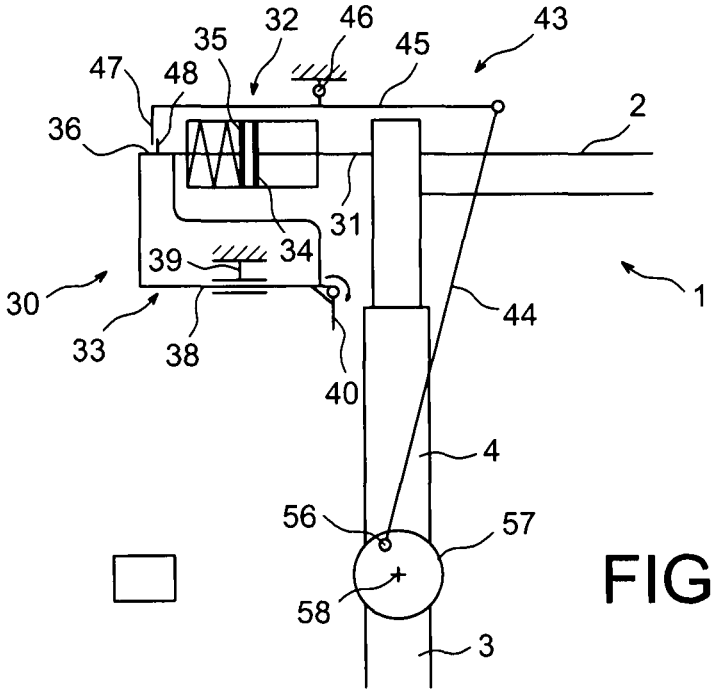

The invention is described with reference to the following figures:

FIGS. 1, 2, and 3 show three successive states in an embodiment in which the invention implements internal latching of the vacuum bottle in the open position during the switch opening stage, then releasing of the latching of the vacuum bottle when the switch re-closes; and FIGS. 4, 5, 6, 7, and 8 show five successive states in an embodiment of an unclaimed circuit breaker which implements internal locking of the vacuum bottle in the closed position during the closing, and the release of the locking when the switch opens or remains open.

FIGS. 1, 2, and 3 show a first embodiment of the invention in which the vacuum bottle is latched in the open position. The electrical circuit comprises a main branch 1 made up of a first stationary portion 2 (itself made up of a top set of busbars and of a stationary stud adjacent to a disconnector 4), and of a second portion 3 made up of a disconnector blade 4 turnable about its axis 5 under drive from a control mechanism (not part of the invention). The circuit further comprises a secondary branch 6, in parallel with the main branch 1, and the secondary branch 6 includes a stationary portion 8 to be connected to the first portion 2 of the main branch 1 (at the junction between the top set of busbars and the stationary stud) and a movable portion 9 suitable for establishing electrical communication with the stationary portion 8 and the disconnector 4. A vacuum bottle 10 is placed in the secondary branch at the junction between the stationary portion 8 and the movable portion 9. The vacuum bottle comprises a stationary contact 11 connected to the stationary portion 8, and a movable contact 12 connected to the movable portion 9 and placed on a rod 13 that slides through the vacuum bottle 10, and that is provided with a washer 14 at an outside end. The vacuum in the vacuum bottle 10 helps to hold the contacts 11 and 12 one against the other, thus ensuring electrical connection between the stationary portion 8 and the movable portion 9. The movable portion 9 further comprises a braid 15 extending from the rod 13 to the conductive portion 16 of the actuator cam 17. The actuator cam 17 turns about an axis 19 parallel to the axis 5 of the disconnector 4 and urged into an abutment position by a spring 20 in which the conductive portion 16 is close to the main branch 1. The actuator cam 17 further comprises two projections 21 and 22, and in the resting position the washer 14 extends between said projections, into a notch 23.

The device further includes a latch finger 24 that turns about an axis 25 that is also parallel to the axis 5. The latch finger 24 comprises: a portion in the same plane as the blades of the disconnector 4, comprising a sliding surface 26 and a flank 28 (said flank 28 serves to latch the actuator cam, and thus to latch the vacuum bottle in the "open" position); and a portion 51 offset from the blades of the disconnector 4 and that performs an "un-latching" function when the switch or circuit breaker is being closed. This portion is activated by a protruding washer 50, projecting from one of the faces of the blades of the disconnector 4. A spring 49 disposed on the axis 25 urges the latch finger 24 towards the actuator cam 17; but the protruding washer 50, at the end of the disconnector 4, may engage with the offset portion. This happens for the closed position of the main branch 1 (FIG. 1), in which the latch finger 24 is spaced apart from the actuator cam 17 and the spring 49 is compressed.

The disconnector 4 is initially in the state shown in dashed lines, in which it establishes a good connection between the portions 2 and 3 of the main branch 1. When the switch opens, the disconnector is moved towards the actuator cam 17, and escapes progressively from the first portion 2 while reaching the lever 16. Since the vacuum bottle 10 is closed, current is transferred little by little from the main branch 1 to the secondary branch 6, passing via the top set of busbars of the first portion 2 to the second portion 3 via the stationary portion 8, the vacuum bottle 10, the rod 13, the braid 15, the lever 16, and the disconnector 4. The disconnector 4 causes the actuator cam 17 to turn by pushing the lever 16 against the action of the spring 20. The disconnector 4 ends up by separating from the first portion 2. The latch finger 24 continues to be held in place, since the actuator cam 17 has its outer edge 52 that slides over the portion 26.

Nevertheless, the other projection 21 ends up by touching the washer 14. Continued turning of the disconnector 4 and of the actuator cam 17 then pulls the rod 13, separates the contacts 11 and 12, opens the vacuum bottle 10, and the electric current is interrupted, with no arc being struck between the blade 4 and the portion 2 because of the bottle. It becomes possible to turn the latch finger 24 when the notch 23 comes into register therewith. Finally, continued turning of the actuator cam 17 also brings the flank 28 as far as the notch 23. The state shown in FIG. 2 is thus reached: the projection 22 from the actuator cam 17 presses against the flank 28, thereby holding the actuator cam 17 and the latch finger 24 in a mutual blocking position in which an inside edge 53, leading to the notch 23, of the second projection 22 and the flank 28 then bear mutually against each other, and the first projection 21 holds the rod 13 extended and the vacuum bottle 10 open, the washer 14 coming into abutment against the projection 21. This state continues when the disconnector 4 moves away from the actuator cam 17 to take up a "disconnected" position (switch/circuit breaker open), or towards a grounding contact 29.

With reference to FIG. 3 the switch is closed as follows: the disconnector 4 is moved in the opposite direction, goes past the lever 16 (which may be retractable, if necessary), and then pushes back the latch finger 24 once the projecting washer 50 has touched the offset portion 51, causing the latch finger 24 to turn about the axis 25 against the spring 49 and separating the flank 28 from the second projection 22 by causing them to slide one on the other. The actuator cam 17 is released, returns to its initial position shown in FIG. 1, and enables the rod 13 to move back into the vacuum bottle 10, which thus re-closes.

Another unclaimed embodiment of a circuit breaker is described below with reference to the following FIGS. 4 to 8: the mechanism in accordance with invention is used to lock the moving portion of the parallel branch when the disconnector is closed.

This other device likewise comprises a main circuit branch 1, made up of two portions 2 and 3, and a disconnector 4 as above; the secondary branch, now referenced 30, is somewhat different, but still comprises a stationary portion 31, a vacuum bottle 32, and a movable portion 33, the vacuum bottle 32 including two facing contacts 34 and 35 that depend respectively from the stationary portion 31 and from the movable portion 33, but the movable portion 33 includes, beyond a rod 36 carrying the contact 35, a slider 38 that moves in a stationary bearing 39. A stop is hinged to the end of the slider arm 38; an abutment 41 holds it in place in the rest position, making an abutment angle with the slider 38, and a spring 42 holds it against the abutment 41. A conductive braid 49 connects the rod 36 to the vicinity of the stop 40.

The device also includes a linkage 43 made up of a first link 44 hinged to a disk 57 forming part of the device for activating the disconnector 4, and a second link hinged to the opposite end of the first link 44 and hinged in its middle to a stationary point 46; this second link 45 has a hook-shaped free end 47 extending in front of a finger 48 of the rod 36, thereby opposing opening of the vacuum bottle 32.

Figure 5:
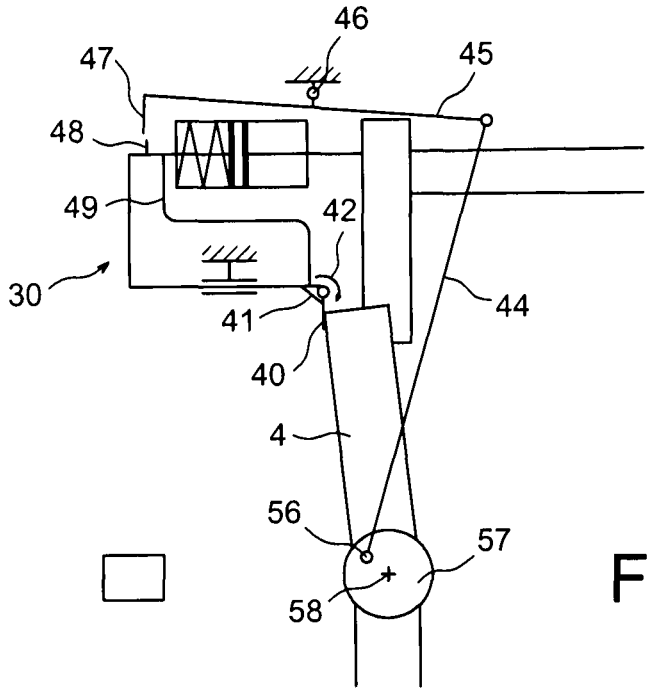
Figure 6:
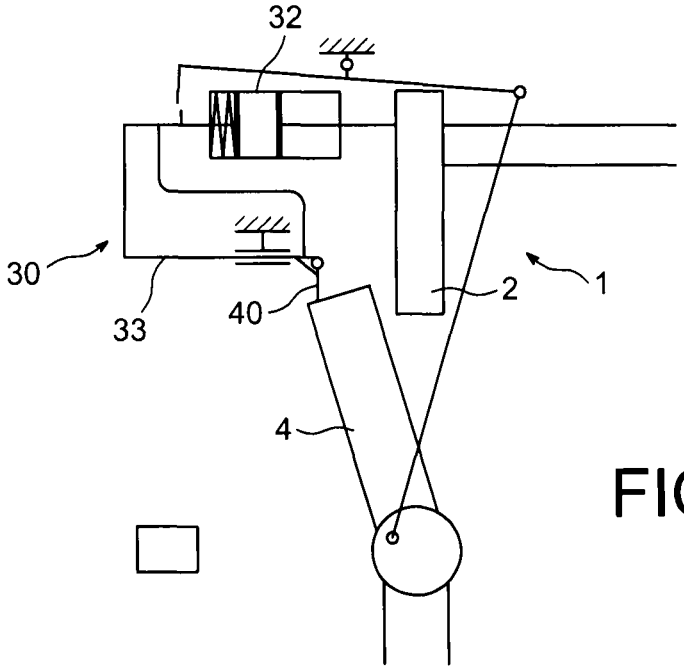
Figure 7:
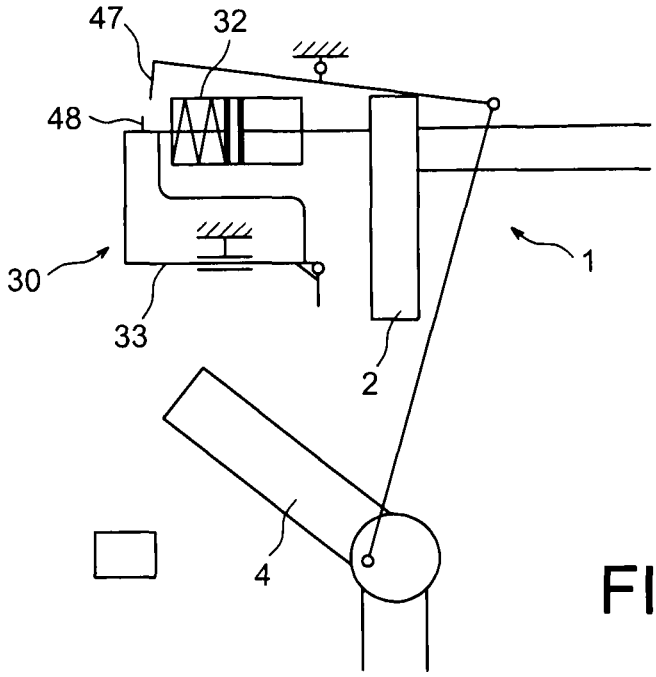

Opening of the switch begins by the state shown in FIG. 5. The disconnector 4 is moved by the control mechanism but continues to touch the stop 40 before separating from the first portion 2, thereby enabling the current to be transferred progressively to the secondary branch 30. The current flows via a braid 49. Since the axis 56 hinging the first link 44 to the disk is at a distance from the hinge axis 58 of the disconnector 4, the first link 44 is pulled downwards in the representation in FIG. 5, thereby causing the second link 45 to pivot about the stationary point 46 and lift the hook 47 away from the finger 48. The releasable locking of the linkage 43 then ceases, and as the movement continues, as shown in FIG. 6, the disconnector 4, now in abutment against the stop 40, moves the stop together with the entire movable portion of the secondary branch 30 and opens the vacuum bottle 32 when the disconnector 4 has separated from the first portion 2 of the main branch 1. As above, no arc is struck between the blade 4 and the portion 2. At the following stage of switch opening, as shown in FIG. 7, the disconnector 4 has gone past the stop 40, thereby releasing the movable portion 33 and allowing the vacuum bottle 32 to re-close, the finger 48 passing under the hook 47. The rotary movement of the disconnector 4 may terminate on a grounding contact 29 as before.

Figure 8:
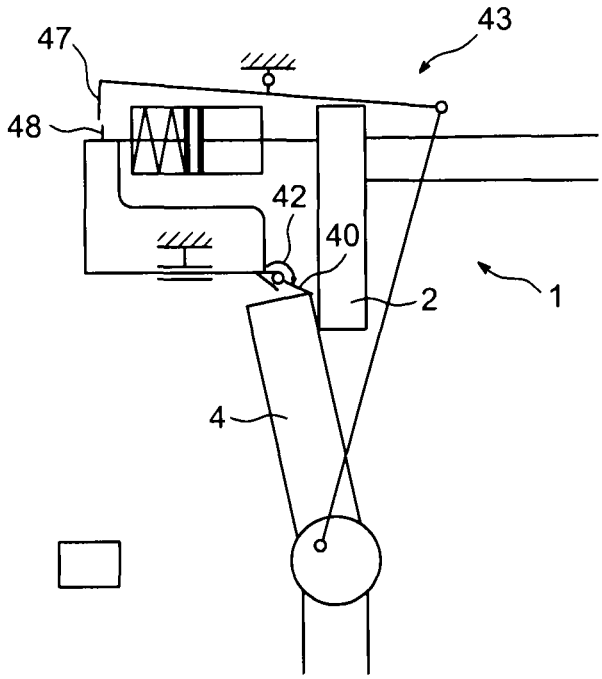

The closing movement of the switch consists essentially in moving the disconnector 4 in the opposite direction back to the first portion 2 of the main branch 1, while moving away the stop 40 against the action of the spring 42. This is shown in FIG. 8. The remainder of the movable portion 33 does not move. The linkage 43 returns to its initial position, the finger 47 moving progressively downwards until it again faces the finger 48, in the position shown in FIG. 4. Locking of the vacuum bottle is then re-established. Providing the face of the stop 40 that rubs against the disconnector 4 during closure is covered in an insulating layer, then current no longer flows through the parallel branch 30.

The invention claimed is:

1. A device associated with a switch or circuit breaker, the device comprising a main branch for the flow of electric current and including a disconnector, a secondary branch for the flow of electric current in parallel with the main branch and including a stationary portion, a movable portion, and a vacuum bottle at the junction between the stationary portion and the movable portion, and the device being arranged in such a manner that the disconnector drives the movable portion during a fraction of a stroke between an open state and a closed state of the device, the device including a mechanism that is movable with the disconnector, and that is arranged in such a manner as to engage with the movable portion of the secondary branch and prevent the movable portion from moving after said fraction of a stroke, the mechanism includes a latch finger that is biased by a spring and that is suitable for being urged against the spring by the disconnector during a first part of a stroke towards switch closure, and in that the movable portion of the secondary branch includes an actuator cam interacting with the latch finger during a second portion of the stroke, the latch finger and the actuator cam presenting mutual slip portions and mutual blocking portions.

2. A device according to claim 1, wherein the actuator cam includes two projections and an intermediate notch in which an element of the movable portion of the secondary branch is retained, the mutual slip and blocking portions of the actuator cam being respectively an outside edge of one of the projections and its inside edge, leading to the notch.

* * * * *